US007237426B2

(12) United States Patent
Baker et al.

(10) Patent No.: US 7,237,426 B2
(45) Date of Patent: Jul. 3, 2007

(54) ROTATIONAL CRIMP DIE

(75) Inventors: James Michael Baker, Memphis, TN (US); George Robertson, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 0 days.

(21) Appl. No.: 11/132,998

(22) Filed: May 19, 2005

(65) Prior Publication Data

US 2005/0257592 A1 Nov. 24, 2005

Related U.S. Application Data

(60) Provisional application No. 60/573,581, filed on May 21, 2004.

(51) Int. Cl.
*H01R 43/042* (2006.01)

(52) U.S. Cl. ..... 72/409.16; 72/416; 29/751; 81/422

(58) Field of Classification Search ..... 72/409.16, 72/404, 416, 414; 81/422; 29/751, 753
See application file for complete search history.

(56) References Cited

U.S. PATENT DOCUMENTS

| | | | | |
|---|---|---|---|---|
| 3,266,695 | A * | 8/1966 | Cervenka et al. | 227/96 |
| 3,633,400 | A | 1/1972 | Wunder | |
| 4,028,756 | A | 6/1977 | Couto | |
| 4,043,174 | A * | 8/1977 | Paolino | 72/412 |
| 4,261,194 | A | 4/1981 | Stephens | |
| 4,926,685 | A * | 5/1990 | Shannon, Sr. | 72/409.11 |
| 5,153,984 | A * | 10/1992 | Beetz et al. | 29/751 |
| 5,307,565 | A | 5/1994 | Erbrick et al. | |
| 5,432,995 | A * | 7/1995 | Takenami et al. | 29/753 |
| 5,913,933 | A * | 6/1999 | Beetz et al. | 72/409.16 |
| 6,109,088 | A | 8/2000 | Schrader et al. | |
| 6,612,147 | B2 * | 9/2003 | Beetz et al. | 72/409.16 |

* cited by examiner

*Primary Examiner*—Daniel C. Crane
(74) *Attorney, Agent, or Firm*—Hoffmann & Baron, LLP

(57) ABSTRACT

A crimp die set for use in a crimping tool is provided, including: a rotating crimp die having a plurality of differently sized male die parts; and a stationary female crimp die having a plurality of differently sized female nests which correspond to one or more of the plurality of male die parts, wherein a rotation of the rotating crimp die permits different crimping action to accommodate different terminal and wire sizes.

14 Claims, 10 Drawing Sheets

ROTATIONAL CRIMP DIE

CROSS-REFERENCE TO RELATED APPLICATIONS

The present application claims priority to provisional application No. 60/573,581 filed May 21, 2004, and entitled "ROTATIONAL CRIMP DIE".

FIELD OF THE INVENTION

This invention relates to a crimp die useful in crimping tools and to crimping tools including such crimp die. More particularly, the present invention relates to a crimp die set including a rotating male crimp die having a plurality of male die parts and a stationary female crimp die having a plurality of female nests which correspond to the plurality of male die parts. The die configuration may be used to provide differential crimping action for efficient crimping of differently sized terminals and wires to form crimped terminal-wire assemblies.

BACKGROUND OF THE INVENTION

In the electrical connection art crimping tools are widely known which crimp connectors or terminals to the stripped ends of electrical wire. Terminals are usually color coded for size in accord with national standards such as the National Electric Code published by the National Fire Protection Association (NFPA) and other standards such as those published by the National Electrical Manufacturers Association (NEMA). Traditional color codes include red, blue and yellow. The color coded terminals may be crimped to insulated or uninsulated wire. Terminals may be used with a range of wire gauges, typically from about 20 American Wire Gauge (AWG) to about 10 AWG. When used to crimped to insulated wire, the terminal usually includes a protective sleeve about a crimp end of the terminal. In this case, the crimping tool is used to crimp both the protective sleeve and the crimp end of the terminal about the stripped end of a wire to form a terminal-wire assembly.

One commercially available crimping tool includes three differently sized die pairs for crimping red, blue or yellow terminals. The tool includes three differently sized male die parts which are matingly accepted into a single female nest. Each male die part is color coded to match the terminal for which it is designed. A limitation of this tool is that it does not take into account different wire gages for each terminal. This configuration does not account for different wire gages for each terminal.

When crimping differently sized wires to a particular color coded terminal using the aforementioned crimping tool, particularly when crimping relatively large gage wires, high handle forces are necessary to provide sufficient crimping action. For example, using the crimping tool described above, the handle force necessary to crimp a 12 gage wire to a yellow terminal may be approximately 50 pounds, while the handle force necessary to crimp a 10 gage wire to a yellow terminal may be in excess of 70 pounds. Repeated application of handle forces in excess of 50 pounds can result in user fatigue and may also pose a risk of injury such as carpal tunnel syndrome.

U.S. Pat. No. 6,109,088 to Schrader et al., discloses a crimping tool having a re-positional die and a cooperating die for use therewith. The crimping tool 100, shown in FIG. 1, includes a die wheel rotatably connected to a frame of a crimping tool by a pivot pin and a mechanism for positioning the die wheel at predetermined rotational positions on the frame. However, this crimping tool has only a single cooperating die mounted to the frame for accepting the die wheel. This configuration necessarily results in uneven crimping due to the differential between the size of the various die configurations on the wheel and the universal die configuration of the cooperating die. It also does not take into account wire size differences for a given die combination. Such uneven crimping is not ideal.

There is a present need for a crimp die configuration and crimping tool which may accommodate not only a variety of color coded terminals, but also a variety of gages of wire to be crimped to such terminals.

SUMMARY OF THE INVENTION

The present invention provides a crimp set die pair for use in a crimping tool, including a rotating crimp die having a plurality of differently sized male die parts; and a stationary female crimp die having a plurality of differently sized female nests which correspond to one or more of the plurality of male die parts. The rotation of the rotating crimp die permits different crimping action to accommodate different terminal and wire sizes.

Further, the present invention includes a crimp set die pair for use in a crimping tool, including a rotational die and a stationary die. The rotational die includes a point of rotation and a plurality of crimping surfaces. Each crimping surface includes at least one crimping projection. The stationary die includes female nests for accepting at least one crimping projection of the rotational die. The rotational die rotates about the point of rotation to provide for access of different crimping configuration to accommodate different terminal and wire sizes.

Furthermore, the present invention includes a crimp set die part for use in a crimping tool, including a rotational die and a stationary die. The rotational die includes two generally square shaped parallel planar surfaces and four crimping surfaces perpendicularly positioned therebetween. Each of the four crimping surfaces includes crimping projections, and the crimping projections include a pair of non-contiguous dissimilar geometric configurations. Each crimping projection is dissimilar from other crimping projections of the crimping surfaces to provide a variety of crimping configurations. The stationary die includes two different sized female nests to accept at least one crimping projection therein. Each of the female nests includes a pair of opposing sidewalls and a bottom surface therebetween. The bottom surface has a convexed portion adjacent to a v-shaped portion. The female nest and the crimping projections jointly provide for different crimping configurations and to accommodate different terminal and wire sizes.

With the foregoing and additional features in mind, this invention will now be described in more detail, and other benefits and advantages thereof will be apparent from the following detailed description, when taken in conjunction with the accompanying drawings.

DETAILED DESCRIPTION OF THE PREFERRED EMBODIMENTS

In accordance with the present invention, a crimp die is provided for use in a crimping tool including a first rotatable crimp part having a plurality of male die configurations for accommodating a variety of terminal and wire sizes; and a second non-rotatable crimp part having a plurality of female die configurations for accepting the male die configurations.

Figure 1:
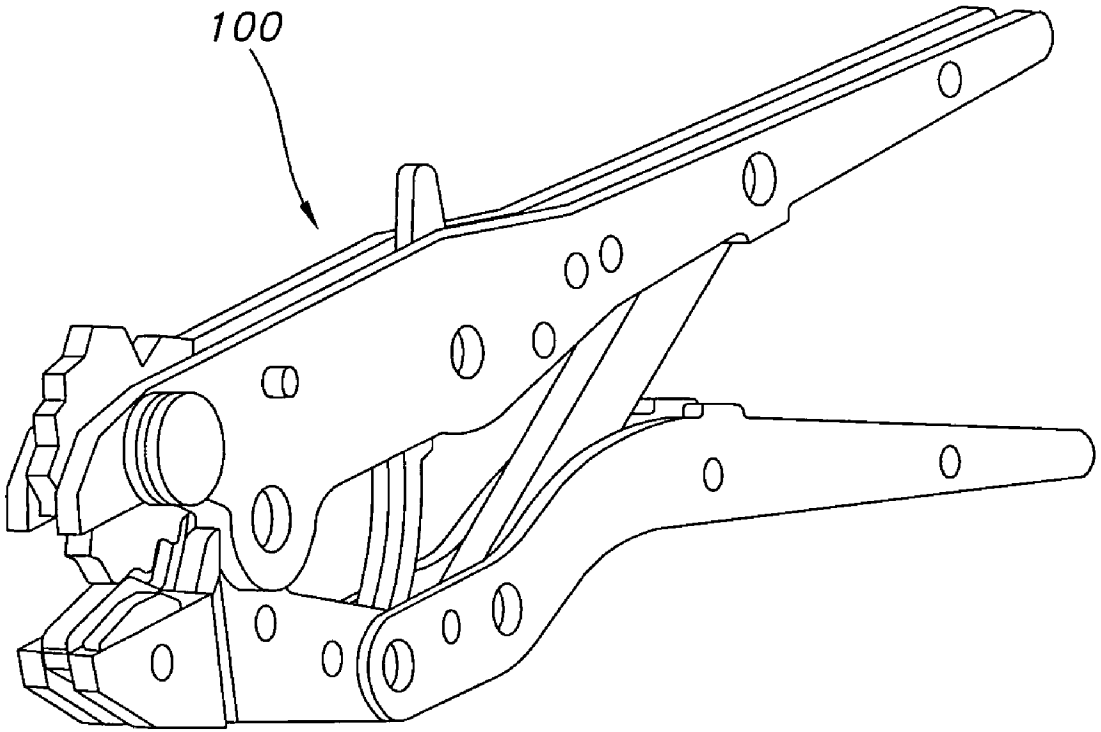
FIG.1 (PRIOR ART)
FIG. 1 is a perspective front view of a known crimping tool.
Figure 2:
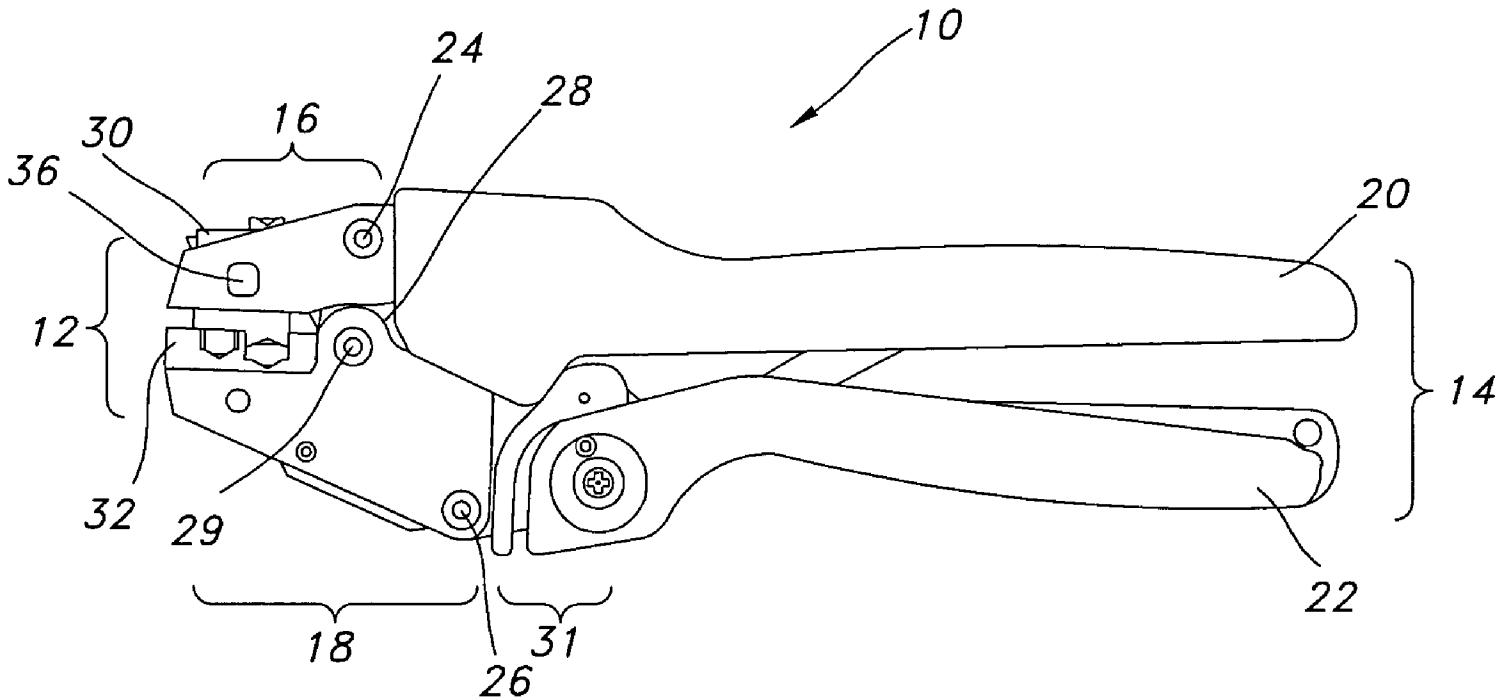
FIG. 2 is a right side plan view of a crimping tool including a rotational crimp die according to the invention.
Figure 3:
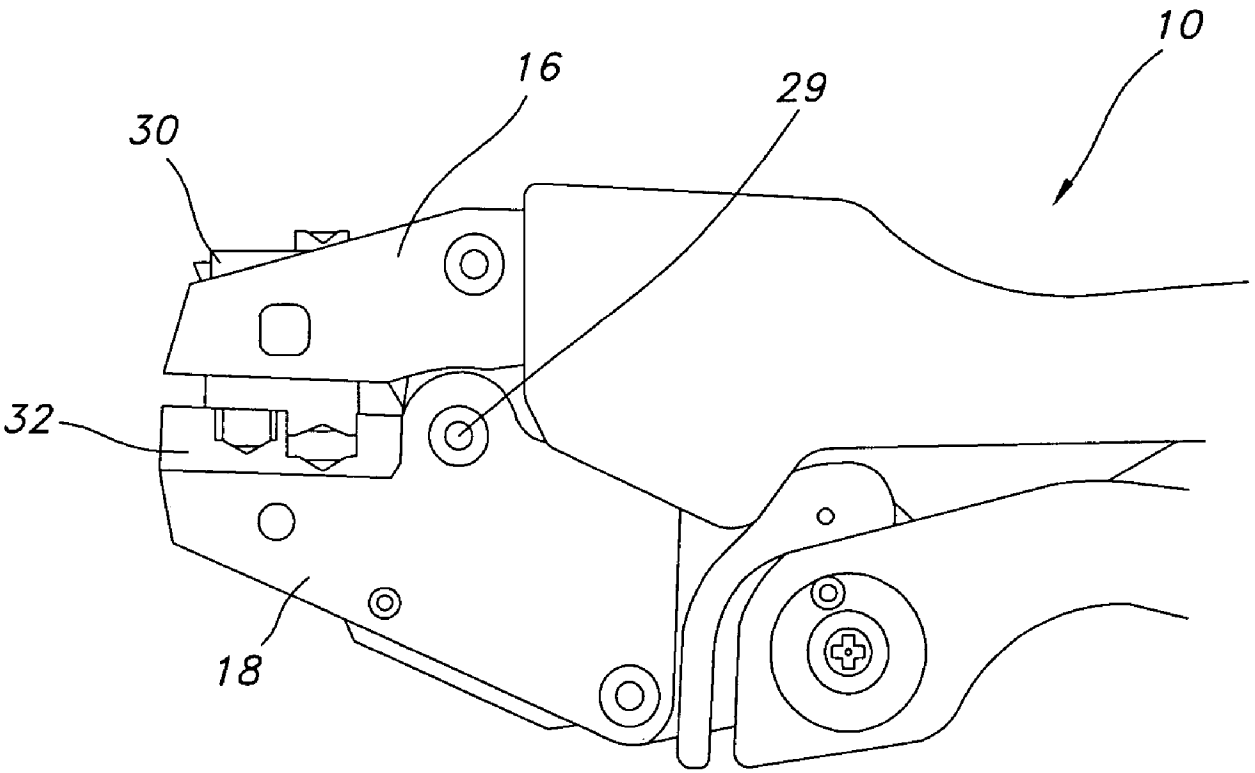
FIG. 3 is an enlarged view of the rotational crimp die shown in FIG. 2.

A crimp die set according to the present invention, is shown in place in a crimping tool in FIGS. 2 and 3. The crimping tool, generally referred to by reference numeral 10, includes a nose portion 12 at one end and a handle portion 14. Nose portion 12 includes a pair of oppositely directed upper and lower jaws, 16 and 18 respectively. Handle portion including an upper (first) handle 20 and a lower (second) handle 22. Upper jaw 16 is operably connected to upper (first) handle 20 by upper (first) joint 24. Lower jaw 18 is (pivotally) connected to lower handle 22 by lower joint 26. Additionally, upper jaw 16 and lower jaw 18 are pivotally connected to a support member 28, which is in communication with handles 20 and 22, via pivot point 29. This pivotal arrangement allows for pivotal operational movement of upper and lower jaws 16 and 18 in relation to one another.

A ratchet mechanism, shown schematically as 31, is pivotally connected to each of upper and lower jaws 16 and 18 to provide for ratchet operation of the tool in a manner which is conventional in the crimping tool art. See, for example, U.S. Pat. No. 5,307,565. This ratchet operation provides a full stroke compelling mechanism to prevent the tool from being operated only partially thereby making an ineffective crimp.

Housed respectively in upper and lower jaws 16 and 18 is a die set according to the invention. The die set includes a rotatable die 30 arranged on upper jaw 16 and a stationary die 32 arranged on lower jaw 18. As will be discussed in further detail below, rotatable die has four differently sized die shapes referred to as crimping projections, with one crimping projection on each of the four sides of rotatable die 30. Stationary die 32 has two differently sized female nests 48*a* and 48*b* for accepting one or more crimping projections 38*a–d*.

Figure 4:
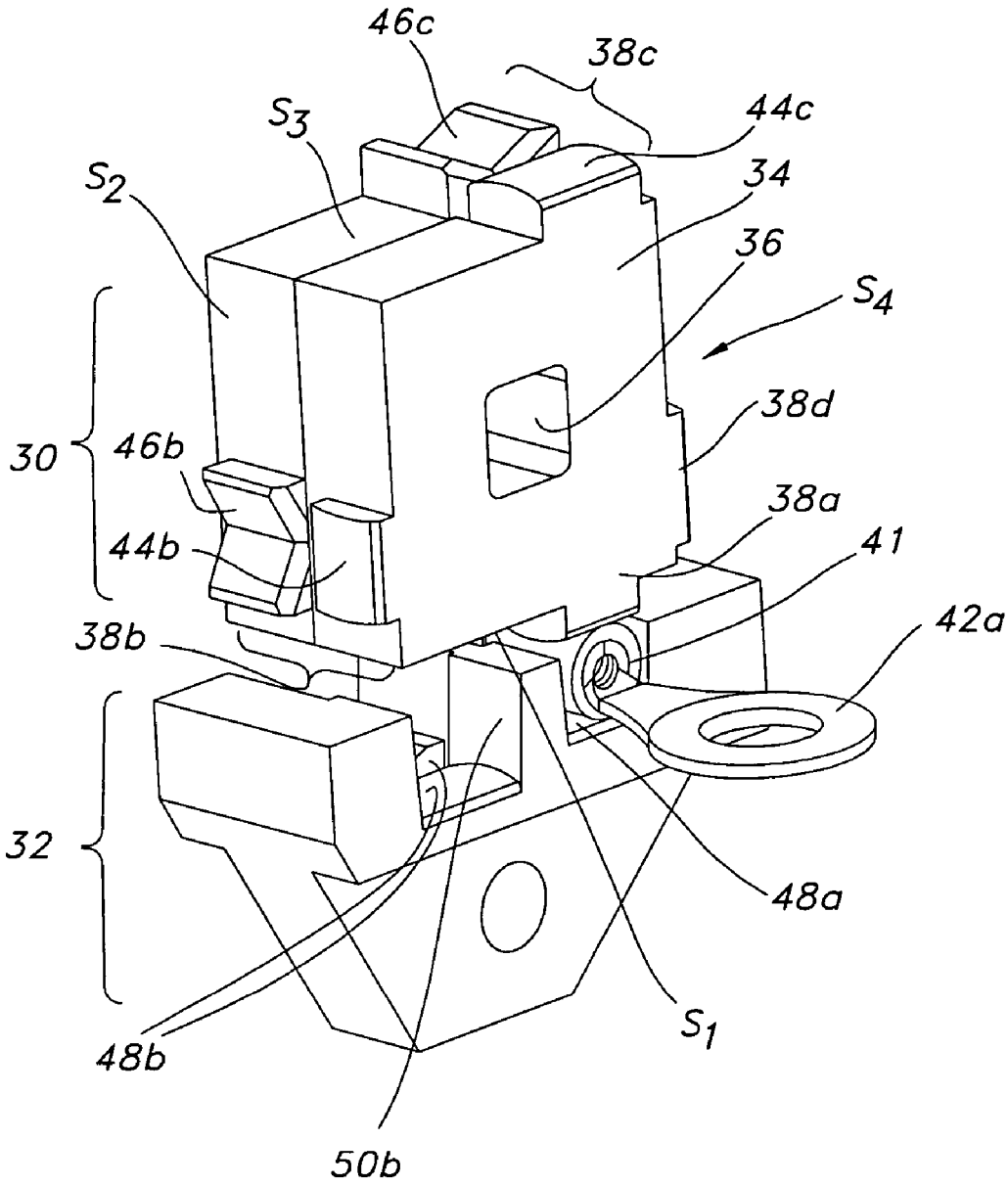
FIG. 4 is a top right perspective view of a crimp die pair of the invention including a rotatable upper die and a stationary lower die, shown with a terminal arranged therebetween.
Figure 5:
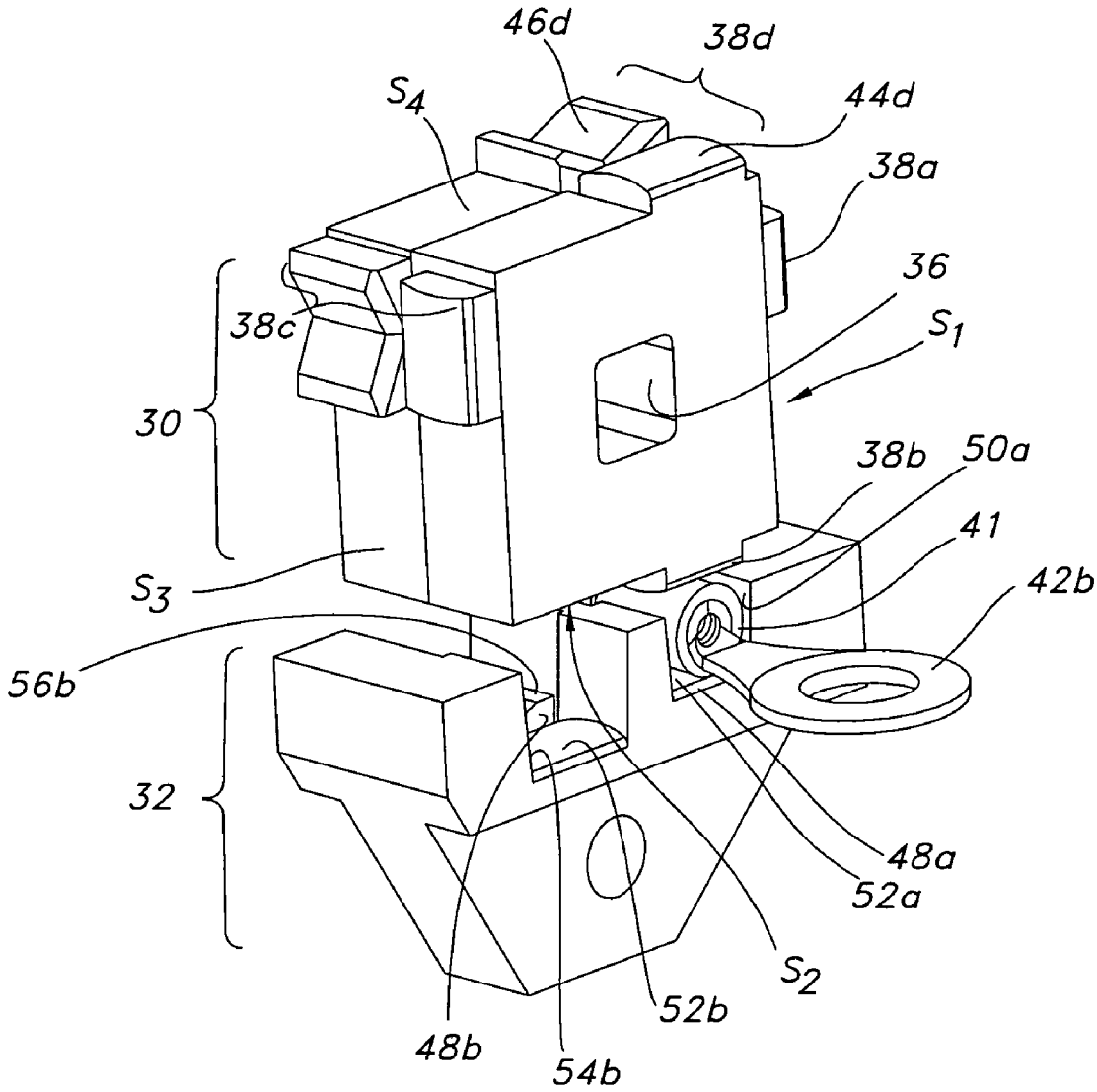
FIG. 5 is a top right perspective view of the die pair as shown in FIG. 4, having a different sized terminal arranged between upper and lower dies of the invention, wherein the upper die has been rotated counterclockwise by 90° from the position shown in FIG. 4.
Figure 6:
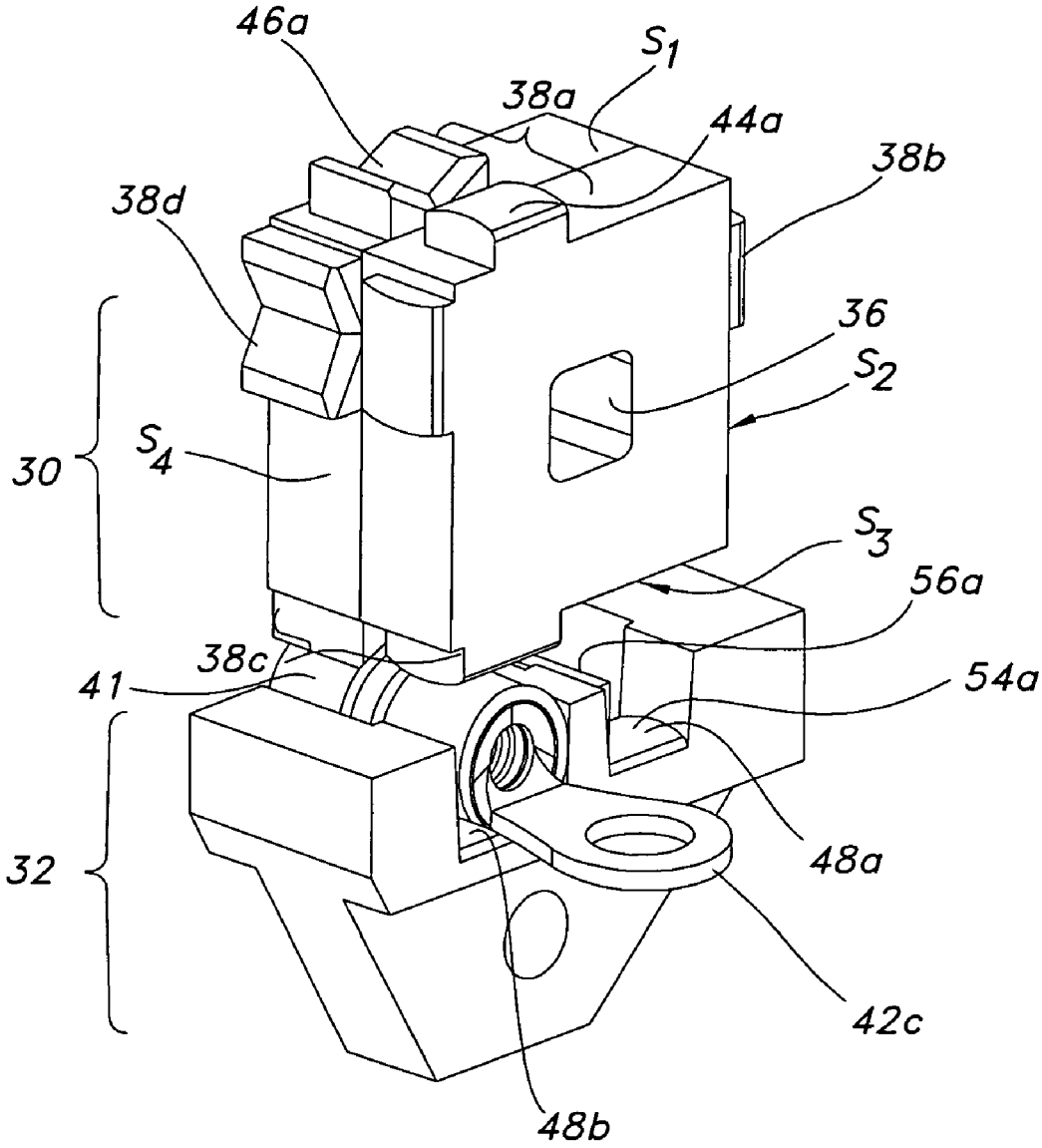
FIG. 6 is a top right perspective view of the die pair as shown in FIG. 5, having a different sized terminal arranged between upper and lower dies of the invention, wherein the upper die has been rotated counterclockwise by 90° from the position shown in FIG. 5.

Referring now to FIGS. 4 to 6, the right side of a die set of the invention, also referred to as the terminal side, is shown. Rotatable die 30, in this embodiment, forms a substantially square base member 34 having four sides, $s_1$, $s_2$, $s_3$ and $s_4$, and a centrally located non-circular aperture 36 therethrough. On each of the four sides $s_1$, $s_2$, $s_3$ and $s_4$, is arrange a differently sized crimping projection 38*a*, 38*b*, 38*c* and 38*d*. Rotatable die 30 is rotatably connected to upper jaw 16 by a pin or axle (not shown) through aperture 36. The size and location of crimping projections 38*a–d* are selected so as to accommodate different terminal 42 and wire sizes combinations.

Stationary die 32 has two differently sized female nests 48*a* and 48*b* arranged linearly along lower jaw 18 which are adapted to accept one or more crimping projections 38*a–d*. Female nests 48*a* and 48*b* are each generally U-shaped having two substantially parallel opposed sidewalls 50*a* and 50*b* that are substantially perpendicular to an axis defined by a barrel 41 of terminal 42*a* arranged therein. Sidewalls 50*a* and 50*b* terminate in a base 52*a* and 52*b*, respectively. Female nests 48*a* and 48*b* define cavities of different sizes with a length of sidewalls 50*a* being less than a length of sidewalls 50*b*. Accordingly, nests are adapted to accept differently sized wires with female nest 48*b* being adapted to accept a smaller gauge wire than female nest 48*a*.

A positioning system is provided for locating rotatable die 30 at predetermined rotational positions on upper jaw 16. The positioning system may be one known in the crimping art, as for example, as is shown in U.S. Pat. No. 4,926,685. Positioning system may be actuated by manual application of pressure on an actuator (not shown) arranged in communication with non-circular aperture 36. Rotatable die 30 may be rotated either clockwise or counterclockwise about an axis which is parallel to an axis of a barrel of a terminal arranged in the tool. Rotatable die 30 may be rotated in 90° increments, namely by 90°, 180°, 270°, etc. increments. However, in practice, it will only be necessary to rotate rotatable die 30 by at most 180° to access any of the various die configurations thereon. Also, other configurations of rotatable die 30 are possible should more or fewer die combinations be desired.

Varying the position of rotatable die 30 with respect to stationary die 32 provides optimal die configurations for four different terminal/wire combinations. Referring now to FIG. 4, a first position of the die pair is shown. In this position, first side $s_1$ of rotatable die 30 is oriented above stationary die 32 so that first crimping projection 38*a* is arranged over first female nest 48*a*. A terminal 42*a* (such as a red terminal) is shown between dies 30 and 32.

Referring now to FIG. 5, a second position of the die pair is shown. In this second position, rotatable die 30 is rotated 90° counterclockwise from that shown in FIG. 4. Second side $s_2$ of rotatable die 30 is oriented above stationary die 32 so that second crimping projection 38*b* is arranged over first female nest 48*a*. A second terminal 42*b* (such as a blue terminal) is shown between dies 30 and 32.

Referring now to FIG. 6, a third position of the die pair is show. In this third position, rotatable die 30 is rotated 90° counterclockwise from that shown in FIG. 5. Third side $s_3$ of rotatable die 30 is oriented above stationary die 32 so that third crimping projection 38*c* is arranged over second female nest 48*b*. A third terminal 42*c* (such as a yellow terminal) is shown between dies 30 and 32. Although not shown, a fourth position of rotatable die is possible. In this fourth position, rotated 90° counterclockwise form that shown in FIG. 6, fourth side of rotatable die will be oriented above stationary die so that fourth crimping projection is arranged over second female nest. A fourth terminal and a large gage wire will fit properly within the die set of the invention in these last two positions so as to permit crimping of large gauge wires to terminals without the necessity for application of excessive handle forces.

The shape of crimping projections is designed to provide enhanced crimping action. As best shown in FIGS. 4 to 6, each crimping projection 38*a–d* has non-contiguous geometric configurations in which a terminal side portion 44*a–d* of crimping projections 38*a–d*possess a different configuration that a wire side portion 46*a–d* of crimping projections 38*a–d*. The differing geometries are selected to enhance crimp results. Specifically, terminal side portions 44*a–d* have a slightly convex shape so as to improve degree of crimping as opposed to, for example, a planar shape. In contrast, wire side portions 46*a–d* are substantially v-shaped so as to provide strain relief to the terminated wire.

Opposed sidewalls 50*a* and 50*b* of female nests 48*a* and 48*b* terminate in a base 52*a* and 52*b* having non-contiguous surface geometries. Specifically, a terminal side portion 54*a* of each base 52*a* and 52*b*, is slightly convex, while a wire side portion 56*a* and 56*b* of each base is substantially v-shaped. These non-contiguous surface geometries are in alignment with corresponding non-contiguous geometries on crimping projections allowing for a crimping pressure uniformly applied and distributed about the terminal-wire assembly. Alignment of female nests 48*a* and 48*b* on lower jaw 18 is selected so that each crimping projection 38*a–d* will fit securely into one or the other female nest 48*a* or 48*b*.

Figure 7:
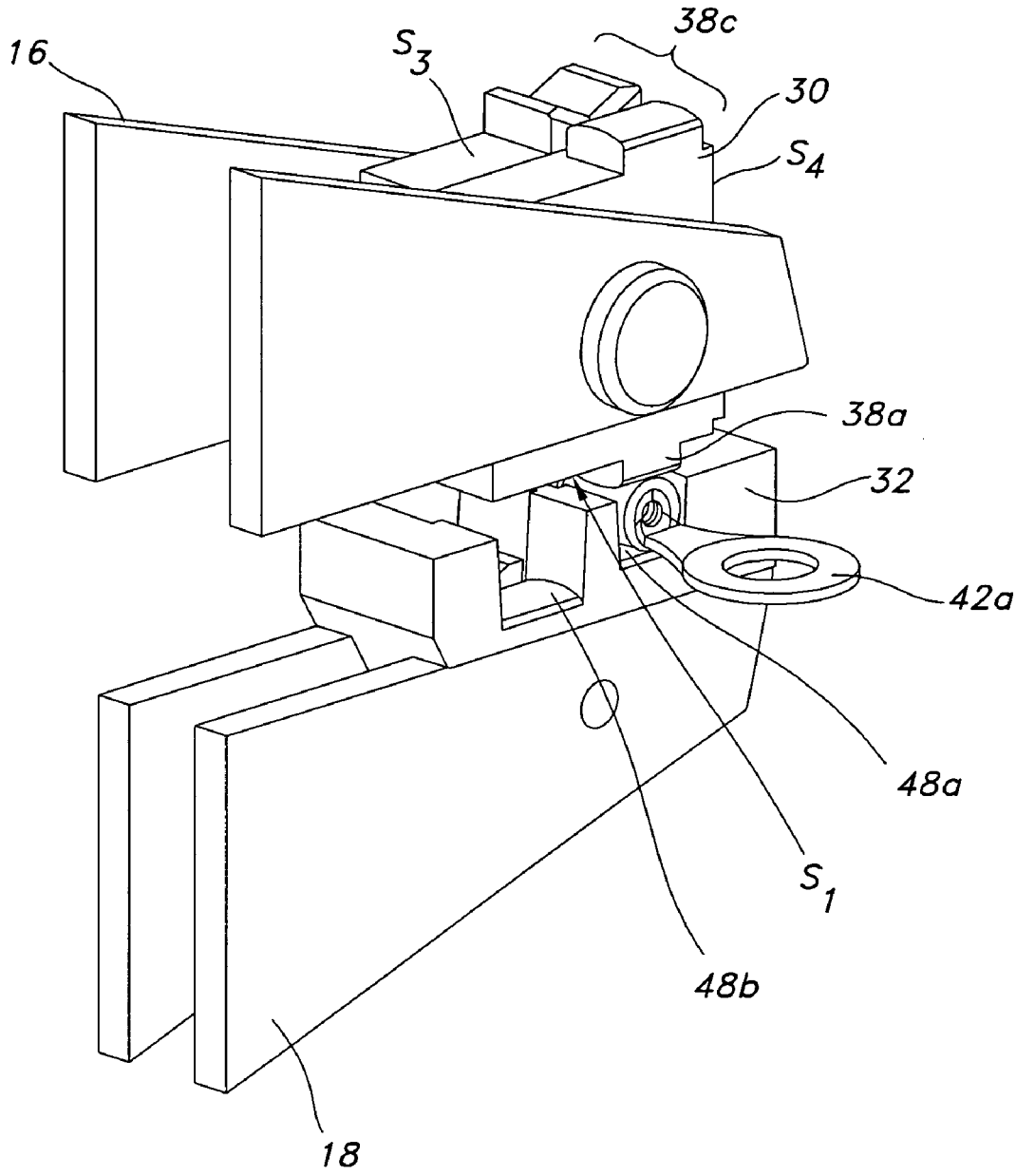
FIG. 7 is a partial right side perspective view of a rotational crimp die of the invention showing a terminal side contour of a female die part.
Figure 8:
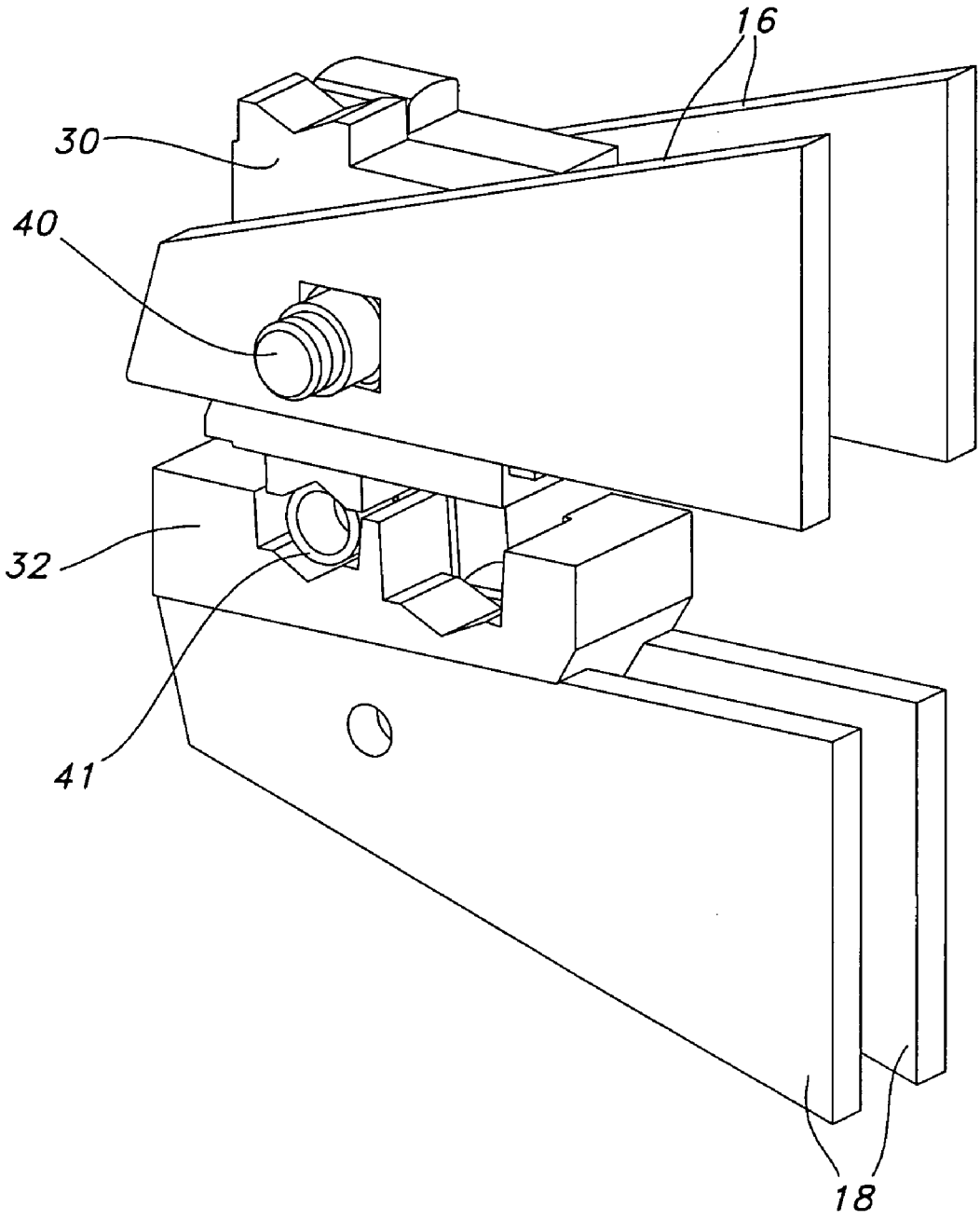
FIG. 8 is a partial left side perspective view of a rotational crimp die of the invention showing a wire side contour of a female die part.

Referring now to FIGS. 7 and 8, a die set oriented as in FIG. 4, is shown arranged in jaws 16 and 18 of the invention. In FIG. 8, showing a left side of the crimping tool 10, actuator 40 is shown as a press button. Actuation of actuator 40 is accomplished in a fashion as is known in the art. See, for example, U.S. Pat. No. 4,926,685, which is herein incorporated by reference.

Figure 9:
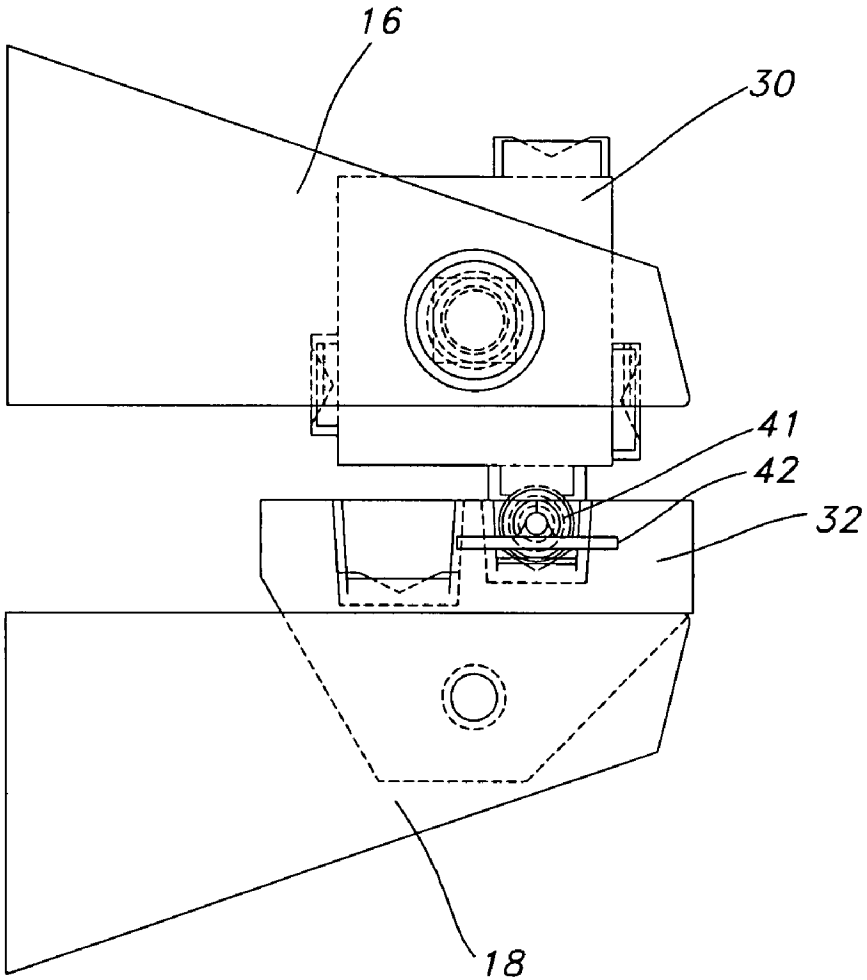
FIG. 9 is partial right side view of a rotational crimp die of the invention showing a wire crimping operation using the rotational crimp die.
Figure 10:
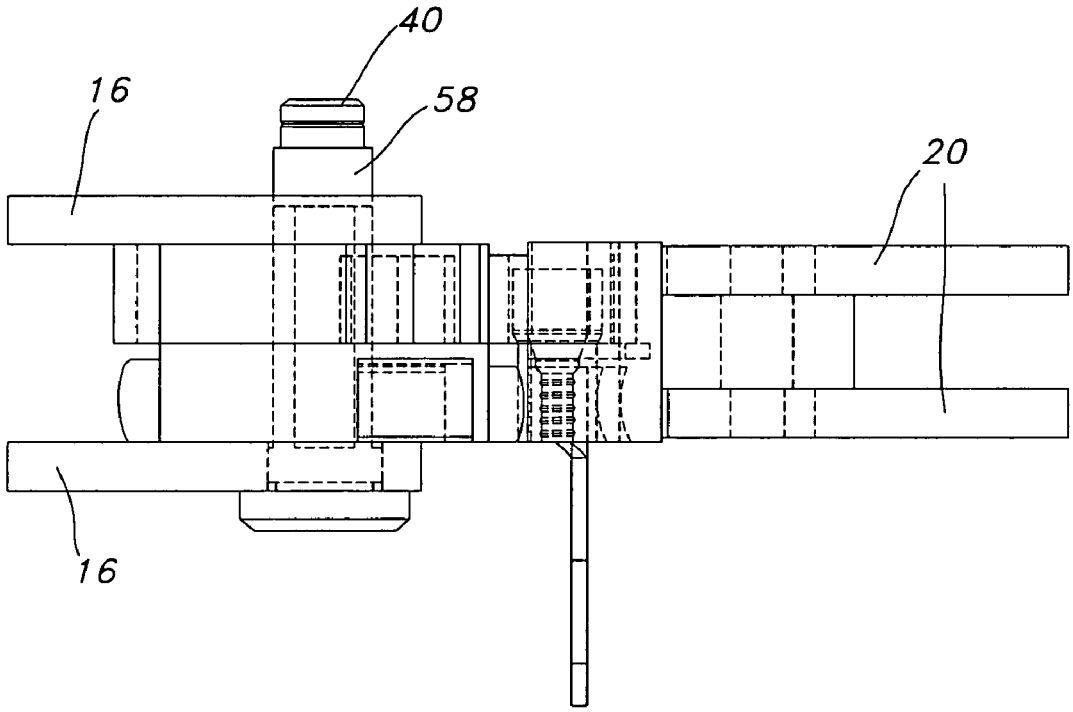
FIG. 10 is an upper plan view of a rotational crimp die of the invention showing detail of a connection between the upper male die and an upper jaw of the crimping tool.

Referring now to FIGS. 9 and 10, actuator 40 is shown having an axle 58 therthrough. Axle 58 has an orthogonal cross-section portion which fits snugly into orthogonal aperture 36. Axle may be spring biased against upper jaw 16 so as to maintain orthogonal cross-section portion of axle 58 in position during use of crimping tool 10. To rotate rotatable die 30, manual pressure on actuator 40 against spring bias will move orthogonal cross-section portion from aperture so that a smaller cross-section portion of axle 58, preferably a circular cross-section portion, resides in aperture 36. In this position (not shown), rotatable die 30 may be rotated to the desired position. Release of pressure on aperture 36 will cause spring bias to return orthogonal cross-section portion of axle 58 to aperture 36 thereby preventing further rotation of rotatable die 30 in aperture 36.

While the invention has been described in relation to the preferred embodiments with several examples, it will be understood by those in the art that various changes may be made without deviating from the spirit and scope of the invention as defined in the appended claims.

What is claimed is:

1. A crimp set die pair for use in a crimping tool, comprising a rotating crimp die about an axis of rotatation having a plurality of differently sized male die parts, at least two of said plurality of male die parts each extending along an axis and being adjacently positioned coaxial relative to one another to one another and parallel to said axis of rotation; and a stationary female crimp die having a plurality of differently sized female nests which correspond to one or more of the plurality of male die parts, wherein a rotation of the rotating crimp die permits different crimping action to accommodate different terminal and wire sizes by selectively cooperating with an appropriate female nest.

2. A crimp set die pair for use in a crimping tool, comprising:

a rotational die having a point of rotation about an axis and a plurality of crimping surfaces, at least two of said plurality of crimping surface each extending along an axis and are coaxial with one another and parallel to said rotational axis, each crimping surface including at least one crimping projection; and a stationary die having female nests for accepting at least one crimping projection of said rotational die, wherein said rotational die rotates about said point of rotation to provide for access of different crimping configuration to accommodate different terminal and wire sizes by selectively cooperating with an appropriate female nest.

3. The crimp set die part of claim 2, wherein said point of rotation includes an aperture and pin, said pin provides attachment of said rotational die to an upper jaw of a crimping tool, said pin cooperatively engages with said aperture to provide rotation of said rotational die in said upper jaw of said crimping tool.

4. The crimp set die part of claim 2, wherein each of said female nests include a pair of opposing sidewalls and a bottom surface therebetween, said bottom surface includes different cavity geometry for accommodating different sized wires thereon.

5. The crimp set die part of claim 4, wherein said different cavity geometry includes a concaved surface portion.

6. The crimp set die part of claim 4, wherein said different cavity geometry includes a convexed surface portion.

7. The crimp set die part of claim 4, wherein said different cavity geometry includes a concaved surface portion adjacent to a convexed surface portion.

8. The crimp set die part of claim 2, wherein said at least one crimping projection includes a terminal side portion and a wire side portion, wherein said terminal side portion has a convex surface and said wire side portion has a concaved surface.

9. The crimp set die part of claim 8, wherein each of said female nests include a pair of opposing sidewalls and a bottom surface therebetween, said bottom surface includes a convexed surface portion, at least one of said terminal side portion of said crimping projection is aligned with said convexed surface portion.

10. The crimp set die part of claim 8, wherein each of said female nests include a pair of opposing sidewalls and a bottom surface therebetween, said bottom surface includes a concaved surface portion, at least one of said wire side portion of said crimping projection is aligned with said concaved surface portion.

11. The crimp set die part of claim 2, wherein each of said female nests include a pair of opposing sidewalls and a bottom surface therebetween, said bottom surface includes a concaved surface portion adjacent to a convexed surface portion, said at least at least one crimping projection includes a terminal side portion adjacent to a wire side portion, said terminal side portion having a convexed surface and said wire side portion having a concaved surface, said terminal side portion is aligned with said convexed surface portion of said female nest and said wire side portion is aligned with said concaved surface portion of said female nest.

12. A crimp set die part for use in a crimping tool, comprising:

a rotational die including two generally square shaped parallel planar surfaces and four crimping surfaces perpendicularly positioned therebetween, each of said four crimping surfaces includes crimping projections, said crimping projections include a pair of non-contiguous dissimilar geometric configurations, each crimping projection being dissimilar from other crimping projections of said crimping surfaces to provide a variety of crimping configurations;

a stationary die having two different sized female nests to accept at least one crimping projection therein, each of said female nests includes a pair of opposing sidewalls and a bottom surface therebetween, said bottom surface having a convexed portion adjacent to a v-shaped portion, said female nest and said crimping projections jointly provide for different crimping configurations and to accommodate different terminal and wire sizes; and a crimping tool, said crimping tool including lower jaws and upper jaws positioned opposite to said lower jaws, said rotational die attached to said upper jaws and said stationary die attached to said lower jaws.

13. The crimp set die part of claim 12, wherein said planar surfaces having a non-circular aperture therethrough to provide a mechanism to rotatably connect said rotational die to an upper jaw of a crimping tool.

14. The crimp set die part of claim 12, wherein said pair of non-contiguous dissimilar geometric configurations includes a convexed terminal side portion adjacent to a v-shaped wire side portion.

* * * * *